US006711886B1

(12) United States Patent
Kwan

(10) Patent No.: US 6,711,886 B1
(45) Date of Patent: Mar. 30, 2004

(54) LINK MEMBERS AND A BAND FORMED OF SUCH LINK MEMBERS

(75) Inventor: Wing Cheuk Kwan, Hong Kong (HK)

(73) Assignee: Chung Nam Watch Co., Ltd. (HK)

( * ) Notice: Subject to any disclaimer, the term of this patent is extended or adjusted under 35 U.S.C. 154(b) by 3 days.

(21) Appl. No.: 10/261,415

(22) Filed: Oct. 2, 2002

(51) Int. Cl.[7] ..... F16G 15/04; F16G 13/00; A44C 5/04

(52) U.S. Cl. ..... 59/80; 59/79.1; 59/82

(58) Field of Search ..... 59/80, 82, 79.1, 59/79.3

(56) References Cited

U.S. PATENT DOCUMENTS 3,786,629 A * 1/1974 Rieth ..... 59/79.1
RE31,681 E * 9/1984 Bert ..... 59/82
5,154,047 A * 10/1992 Takagi ..... 59/80
5,220,780 A * 6/1993 Bert ..... 59/79.1
6,272,836 B1 * 8/2001 Fat ..... 59/80
6,406,177 B1 * 6/2002 Fukushima et al. ..... 368/281

* cited by examiner

*Primary Examiner*—David Jones
(74) *Attorney, Agent, or Firm*—Burns, Doane, Swecker & Mathis, L.L.P.

(57) ABSTRACT

There is disclosed a link for forming a band, the link being formed of an outer casing formed of a plate made of titanium or stainless steel, and an inner part made of aluminum, zinc, an aluminum alloy comprising at least 90 wt. % of aluminum, or a zinc alloy comprising at least 90 wt. % of zinc. There is also disclosed a band made of such links inter-engaged with one another.

11 Claims, 4 Drawing Sheets

LINK MEMBERS AND A BAND FORMED OF SUCH LINK MEMBERS

This invention relates to link members adapted to form bands, e.g. for watches and bracelets and the like, and a band formed of such link members.

BACKGROUND OF THE INVENTION

In metal watch bands formed of inter-engaging metal links, the links are usually made of a single relatively hard metal, e.g. stainless steel, in order to withstand wear and tear during use. A shortcoming associated with such conventional links is that such metal is usually expensive. It is also difficult to drill holes in the links for insertion of linking pins for connection purpose, thus making manufacture of such links costly, time consuming and difficult.

It is thus an object of the present invention to provide a link member and a band formed of such link members in which the aforesaid shortcomings are mitigated, or at least to provide a useful alternative to the public.

SUMMARY OF THE INVENTION

According to a first aspect of the present invention, there is provided a link member adapted to form a band, said link member including an outer casing formed of a plate made of a first metal, and an inner part made at least of a second metal, wherein said first metal is stainless steel or titanium, and wherein said second metal is aluminum, zinc, an aluminum alloy, or a lead alloy.

According to a second aspect of the present invention, there is provided a band including a plurality of link members inter-engaged with one another, wherein at least one said link member includes an outer casing formed of a plate made of a first metal, and an inner part made at least of a second metal, wherein said first metal is stainless steel or titanium, and wherein said second metal is aluminum, zinc, an aluminum alloy, or a zinc alloy.

BRIEF DESCRIPTION OF THE DRAWINGS

Embodiments of the present invention will now be described, by way of examples only, with reference to the following drawings, in which.

DETAILED DESCRIPTION OF THE PREFERRED EMBODIMENTS

Figure 1:
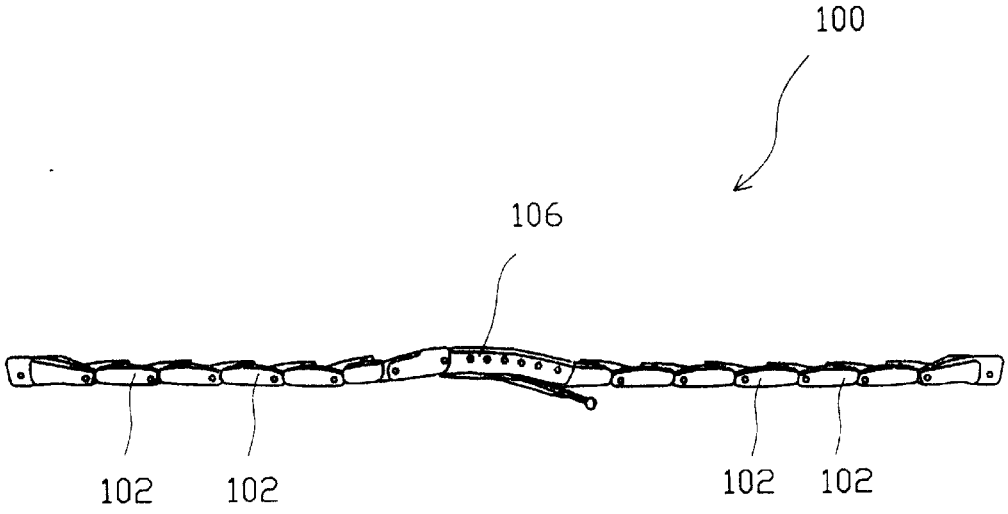
FIG. 1 is a side view of a first watch band made of inter-engaging links according to the present invention.
Figure 2:
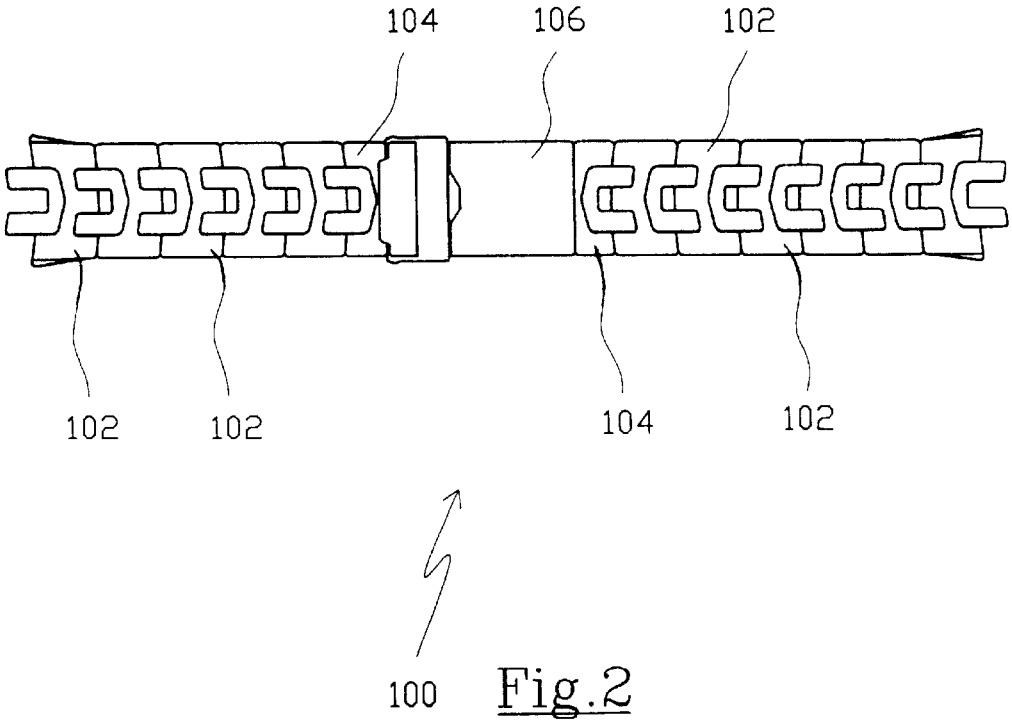
FIG. 2 is a top view of the watch band shown in FIG. 1.

FIGS. 1 and 2 show, respectively, a side view and a top view of a first watch band, generally designated as 100, made by linking up a number of links 102, 104 according to the present invention. A number of the links 102 are connected by stainless steel pins (not shown) to form chains of links 102 in which the links 102 are movable relative to one another. One of the links 102 is connected with the link 104, which is in turn connected to a buckle 106. All such connections are made possible by stainless pins (not shown), whereby the various links 102, 104 and the buckle 106 are movable relative to one another.

Figure 3:
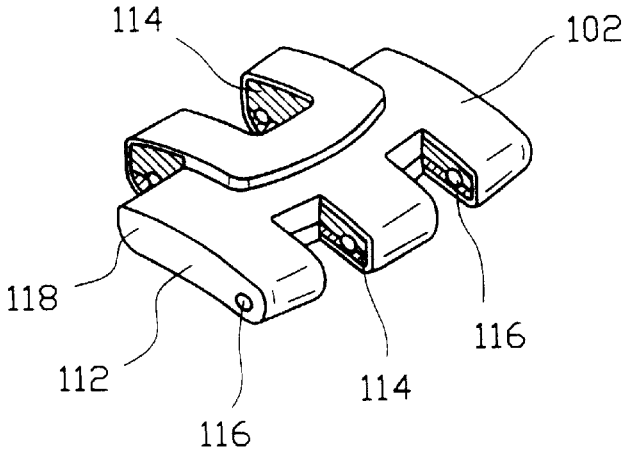
FIG. 3 is a perspective view of a first link according to the present invention, and forming part of the watch band in FIG. 1.

Turning to FIG. 3, such shows a perspective view of the link 102. The link 102 is made of an outer casing 112 made of titanium or stainless steel. The casing 112 is formed by bending a suitably shaped titanium or stainless steel plate into the shape and configuration as shown in FIG. 3. The titanium or stainless steel plate may be of a thickness of around 0.5 mm, although it should be understood that such may be of some other thickness. Housed within the casing 112 are two plates 114 made of aluminum or an aluminum alloy comprising at least 90 wt. % of aluminum. The alloy may include magnesium or, additionally, manganese.

Figure 4:
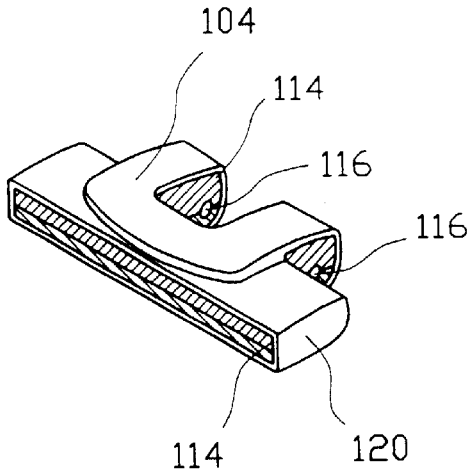
FIG. 4 is a perspective view of a second link according to the present invention, and forming part of the watch band in FIG. 1.

A number of channels 116 are provided in the plates 114 and the casing 112. As aluminum and aluminum alloys are softer than titanium or stainless steel, it is easier to provide such channels 116, than if the whole link 102 is made of titanium or stainless steel. A stainless steel pin (not shown) may be received within aligned channels 116 to connect adjacent links 102, 104. It can also be seen that at least two outer side surfaces of the links 102, 104, of which only a respective one 118, 120 is shown in FIGS. 3 and 4, are covered by the outer casing 112.

A potential difference will develop because of the contact between the titanium or stainless steel casing 112 and the inner aluminum or aluminum alloy plates 114, as a result of which the inner plates 114 will suffer from sacrificial corrosion. As the metal forming the casing 112 will experience corrosion, e.g. oxidation, at a lesser rate than when it stands alone, e.g. in conventional links made of titanium or stainless steel alone, its surface texture, e.g. brightness, can remain intact for a longer period of time. In order, however, to lessen the rate of sacrificial corrosion of the inner plates 114, the aluminum or aluminum alloys may first undergo oxidation to reduce the resultant potential difference between the casing 112 and the plates 114.

Figure 5:
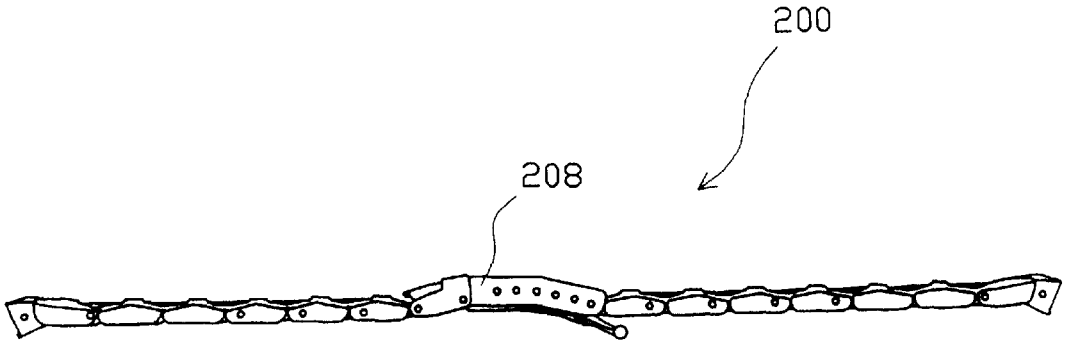
FIG. 5 is a side view of a second watch band made of inter-engaging links according to the present invention.
Figure 6:
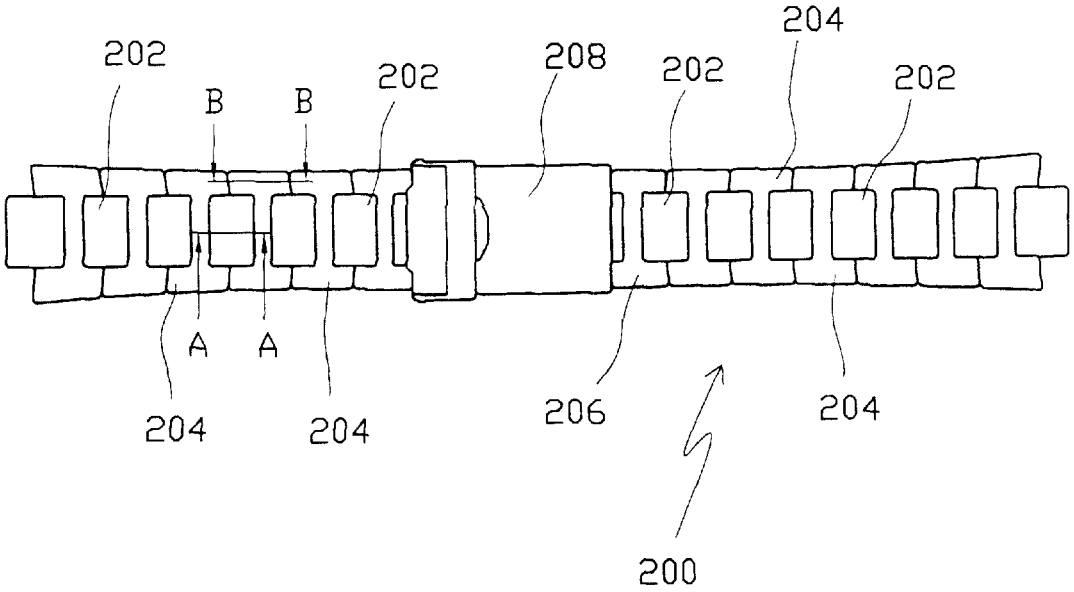
FIG. 6 is a top view of the watch band shown in FIG. 5.

FIGS. 5 and 6 show, respectively, a side view and a top view of a second watch band, generally designated as 200, made by linking up a number of links 202, 204, 206 according to the present invention. A number of the links 202 and 204 are connected by stainless steel pins (not shown) to form chains of relatively movable links 202, 204. The link 206 is connected with a buckle 208. All such connections are made possible by stainless pins (not shown), whereby the various links 202, 204, 206 and the buckle 208 are movable relative to one another.

Figure 7A:
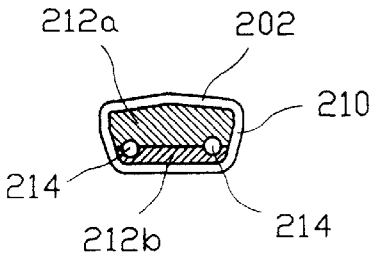
FIG. 7A is a cross sectional view of a third link according to the present invention taken along the line A—A in FIG. 6.
Figure 7B:
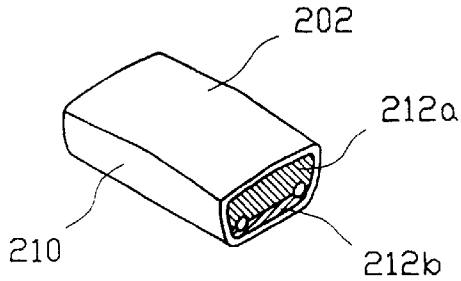
FIG. 7B is a perspective view of the third link shown in FIG. 7A.

FIGS. 7A and 7B show different views of the link 202. The link 202 includes an outer titanium or stainless steel casing 210 surrounding and contacting two inner plates 212*a*, 212*b* made of aluminum or an aluminum alloy. The casing 210 is formed by bending a suitably shaped plate. Two channels 214 are formed between the two inner plates

212*a*, 212*b*, allowing insertion of a respective stainless steel pin (not shown).

Figure 8A:
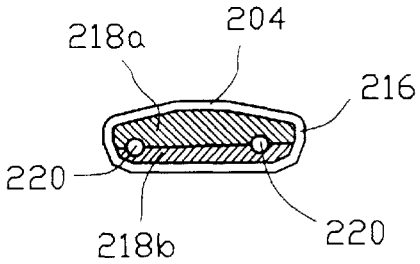
FIG. 8A is a cross sectional view of a fourth link according to the present invention taken along the line B—B in FIG. 6.
Figure 8B:
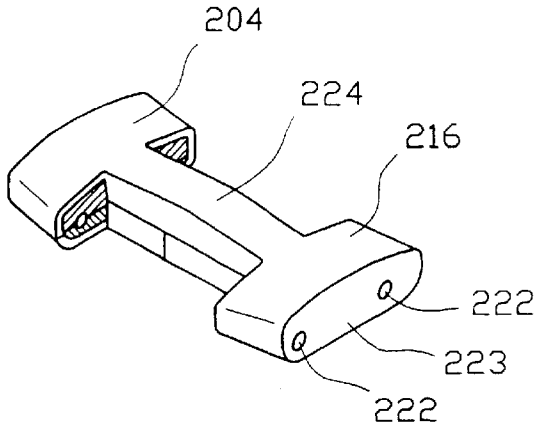
FIG. 8B is a perspective view of the fourth link shown in FIG. 8A.
Figure 9:
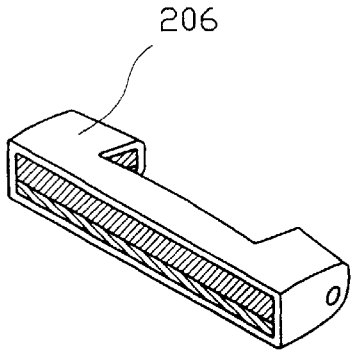
FIG. 9 is a perspective view of a fifth link according to the present invention.

As to FIGS. 8A and 8B, such show, respectively, a sectional view and a perspective view of the link 204. The cross-sectional shape of the link 204 is similar to a letter "H", and its titanium or stainless steel outer casing 216 contains two aluminum or aluminum alloy plates 218*a*, 218*b*, between which two channels 220 are formed. The channels 220 are aligned with apertures 222 formed on two outer side surfaces 223, of which only one is shown in FIG. 8B, of the link 204 for forming two continuous holes, each for receiving a stainless steel pin (not shown) for joining the link 204 with two links 202, one on each side of a bridging portion 224 of the link 204. FIG. 9 shows a perspective view of the link 206 for connection with the buckle 208.

Although it is described and shown here that two plates 114, 212*a*, 212*b*, 218*a*, 218*b* of aluminum or aluminum alloy are housed in the respective casing 112, 210, 216, it should of course be understood that the inner part of the casing 112, 210, 216 may be housed with different number of, e.g. one, three or four, such plates 114, 212*a*, 212*b*, 218*a*, 218*b*. It should also be noted that the plate(s) 114, 212*a*, 212*b*, 218*a*, 218*a*may also be made of zinc described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. A link member adapted to form a band, said link member including an outer casing formed of a plate made of a first metal, and an inner part made at least of a second metal, wherein said first metal is stainless steel or titanium, and wherein said second metal is aluminum, zinc, an aluminum alloy, or a lead alloy.

2. A link member according to claim 1 wherein said aluminum alloy comprises at least 90 wt. % of aluminum.

3. A link member according to claim 1 wherein said aluminum alloy includes at least magnesium.

4. A link member according to claim 1 wherein said aluminum alloy includes at least manganese.

5. A link member according to claim 1 wherein said zinc alloy comprises at least 90 wt. % of zinc.

6. A link member according to claim 1 wherein said second metal is oxidized.

7. A link member according to claim 1 wherein said outer casing covers at least part of one outer side surface of said link member.

8. A link member according to claim 7 wherein said outer casing covers at least part of two outer side surfaces of said link member.

9. A link member according to claim 1 wherein a plurality of holes are formed in said outer casing and inner part, being adapted to receive a pin member.

10. A link member according to claim 9 wherein said pin member is made of stainless steel.

11. A band including a plurality of link members interengaged with one another, wherein at least one said link member includes an outer casing formed of a plate made of a first metal, and an inner part made at least of a second metal, wherein said first metal is stainless steel or titanium, and wherein said second metal is aluminum, zinc, an aluminum alloy, or a zinc alloy.

* * * * *